United States Patent [19]

Matthews, Jr.

[11] Patent Number: 4,573,587

[45] Date of Patent: Mar. 4, 1986

[54] TIRE DISPLAY STAND

[75] Inventor: John S. Matthews, Jr., Dearborn, Mich.

[73] Assignee: The Goodyear Tire & Rubber Company, Akron, Ohio

[21] Appl. No.: 616,629

[22] Filed: Jun. 4, 1984

[51] Int. Cl.[4] ..... A47F 7/04

[52] U.S. Cl. ..... 211/24; 211/23; 248/172

[58] Field of Search ..... 211/24, 23, 43, 41; 248/448, 441.1, 172

[56] References Cited

U.S. PATENT DOCUMENTS

| | | | |
|---|---|---|---|
| 919,923 | 4/1909 | McNatt | 248/448 |
| 1,135,751 | 4/1915 | Balaban | 248/448 |
| 1,320,769 | 11/1919 | Lee | 211/24 |
| 1,913,629 | 6/1933 | Fredrickson | 248/359.1 |
| 2,504,947 | 4/1950 | Grange | 211/24 X |
| 4,046,260 | 9/1977 | Tallon | 211/24 |

FOREIGN PATENT DOCUMENTS

| | | | |
|---|---|---|---|
| 119001 | 6/1947 | Sweden | 211/24 |
| 686208 | 1/1953 | United Kingdom . | |

*Primary Examiner*—Robert W. Gibson, Jr.
*Assistant Examiner*—Blair M. Johnson
*Attorney, Agent, or Firm*—L. R. Drayer

[57] ABSTRACT

A tire display stand comprises a base member formed from a single sheet of material, a telescoping vertical support member attached to the base member, a pair of elastomeric tread support members attached to the base member, and an elastomeric bead support member attached to the top end of the telescoping vertical support member.

1 Claim, 2 Drawing Figures

TIRE DISPLAY STAND

BACKGROUND OF THE INVENTION

The present invention generally relates to a stand for displaying a tire and more particularly to an adjustable stand for displaying a tire.

Several types of tire display stands are known from the prior art. A first type of display stand seizes the lower part of a tire in an interference type of fit and thus holds the tire upright. This first type of display stand normally is made of plastic or cardboard and doesn't accommodate a wide range of tire sizes. A second type of display stand suspends the tire from a hook or other retaining device, and may be unstable in actual use. A third type of display stand, which is taught in U.S. Pat. No. 4,046,260, is a collapsible frame of heavy metal wire which combines the first two types of display stands to some degree. This third type of display stand is not adjustable for various sizes of tires either. British Patent Specification No. 686,208 teaches a fourth type of tire display stand that is adjustable for displaying tires of different bead diameters. However, the tire display stand taught in British Patent Specification No. 686,208 has a welded angle iron base that will not grip the tread of various size tires in the manner of applicant's new tire display stand to provide needed stability to a tire display.

SUMMARY OF THE INVENTION

There is provided in accordance with an aspect of the invention a tire display stand having a base member comprising a single sheet of material having a pair of parallel edges, said single sheet being formed to define a flat horizontal central portion and a pair of end portions which each include one of said parallel edges, said end portions being inclined upwardly at acute angles from a horizontal plane. An adjustable height vertical support member has a lower end that is attached by means for attachment to the central portion of said base member equidistant from said end portions, an upper end of said vertical support member having a generally horizontally extending platform attached thereto by means for attachment. An elongated elastomeric tread supporting member is attached by means for attachment to an upper surface of each end portion of the base member. Each tread supporting member has a longitudinal axis that is parallel to the parallel edge of the base member that is included in the end portion of the base member to which the tread supporting member is attached. Each tread supporting member presents an arcuate surface having an axis that is parallel to the longitudinal axis of the tread supporting member. An elastomeric bead supporting member is attached by means for attachment to a top surface of said platform. The bead supporting member has an upper surface with a groove therein. Said groove extends generally horizontally and is oriented perpendicular to vertical planes containing the longitudinal axes of the tread supporting members.

BRIEF DESCRIPTION OF THE DRAWINGS

The features of the present invention which are believed to be novel are set forth with particularity in the appended claims. The present invention, both as to its structure and manner of operation, may best be understood by reference to the following description, taken in accordance with the accompanying drawings in which:

DETAILED DESCRIPTION OF THE INVENTION

Figure 1:
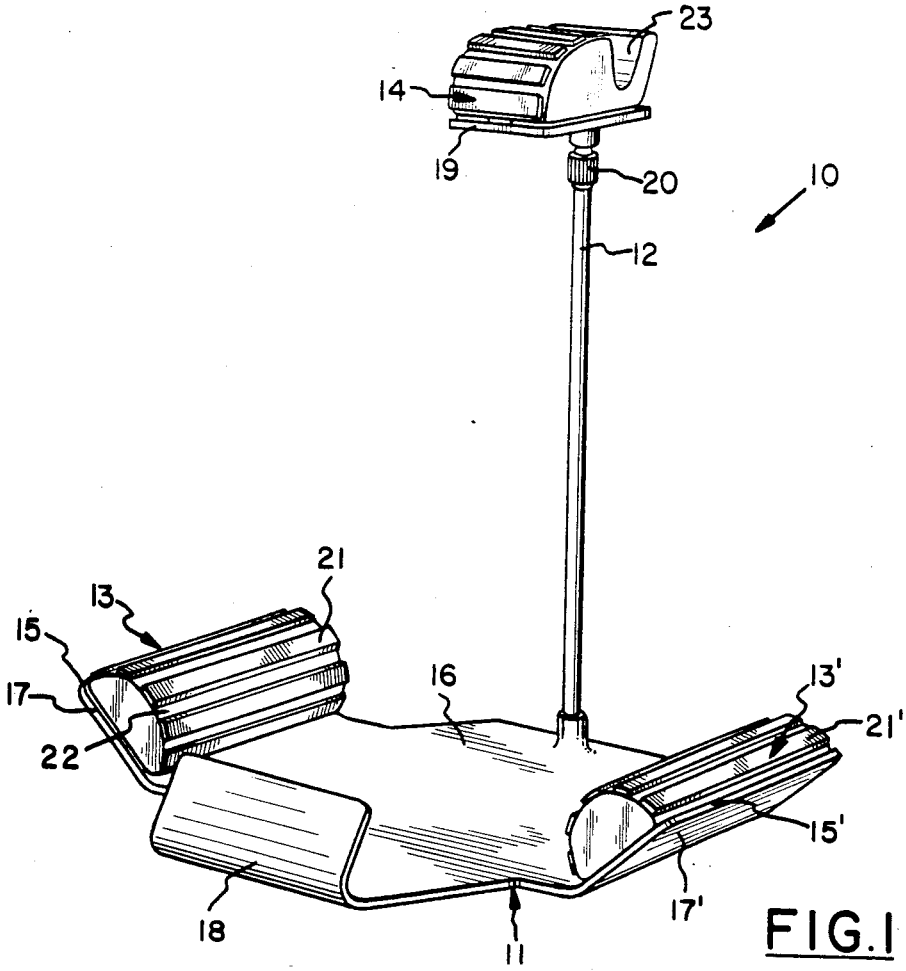
FIG. 1 is a perspective view of a tire display stand according to the preferred embodiment of the invention.

Referring to FIG. 1 there is shown a perspective view of a tire display stand 10 manufactured in accordance with a preferred embodiment of the invention. The tire display stand 10 comprises a base member 11, a telescoping vertical support member 12, a pair of elastomeric tread supporting members 13,13' and an elastomeric bead supporting member 14.

The base member 11 comprises a single sheet of a suitable material having a pair of parallel edges 15 and 15'. While the base member may be cast metal or even injection molded plastic, it is preferably formed from a sheet of aluminum or similar material in a manner that will be hereinafter described. The single sheet of material is formed to define a flat horizontal central portion 16 and a pair of end portions 17 and 17', each of said end portions including one of the parallel edges 15,15' of the single piece base member. The end portions 17 and 17' are preferably inclined upwardly at acute angles of in the range of 35° to 45°, most preferably in the range of 40° to 43°, from a horizontal plane. The base member may optionally have a hook shaped projection 18 extending along one edge thereof in a direction substantially perpendicular to said parallel edges 15,15'. The hook shaped projection serves a dual purpose; it may help to retain a tire in position on the display stand; and, it may have indicia identifying the tire or the manufacturer of the tire attached thereto.

Figure 2:
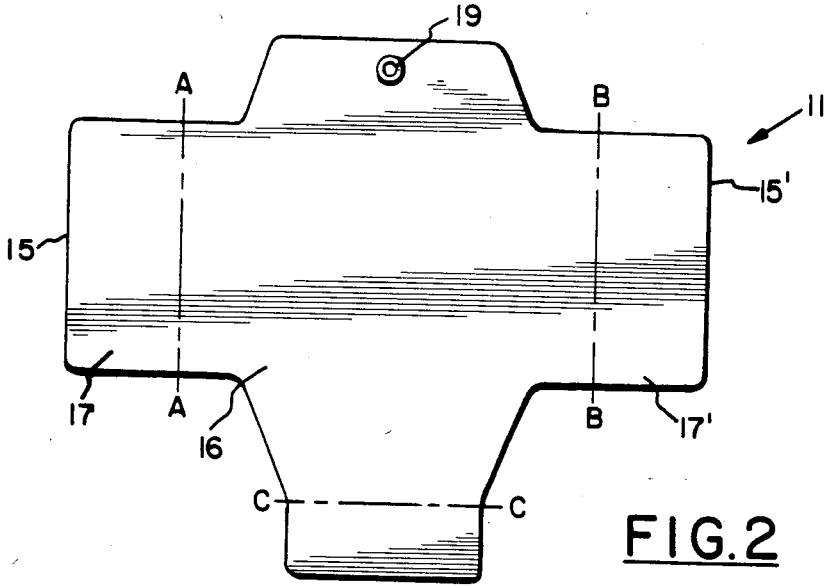
FIG. 2 is a plan view of a blank of sheet material that may be formed into a base for the tire display stand illustrated in FIG. 1.

A method of manufacturing a base member 11 from a single sheet of material may be described with reference to FIG. 2 which shows a blank of sheet material. The end portions 17 and 17' are formed by folding or bending the sheet upwardly along lines A—A and B—B at an acute angle with respect to a horizontal plane. The hook shaped projection 18 is formed by folding or bending the sheet material upwardly along line C—C. A threaded boss 19 may be provided for receiving the vertical support member 12. It is understood that the blank of sheet material illustrated in FIG. 2 is merely one example of a base member that may be employed in practicing the applicant's invention. For example, the blank sheet of material could be substantially rectangular with no provision for any type of projection 18 extending perpendicular to the two parallel ends 15 of the blank.

The adjustable height vertical support member 12 has a lower end that is attached by a means for attachment, (such as threads, press fitting, or even welding), to the central portion of the base member 11. The vertical support member may be either located on a straight line connecting the end portions of the base member, or offset to one side as shown in FIG. 1, so long as it is equidistant from the two end portions 17 and 17' of the base member. By employing this configuration, the bead support member 14 will engage a bead portion of a tire at the highest point of said bead portion when the tire is on display. The upper end of the vertical support member has a generally horizontally extending platform 19 attached thereto by any suitable means for attachment, which is understood to mean that the platform may be integral to the vertical support member. The vertical support member 12 comprises a plurality of telescoping sections, of any suitable cross-sectional configuration, and should have some locking mechanism such as a threaded ferrule 20, or even a simple set screw, to maintain the desired height of the vertical support member. It is understood that while in the preferred embodiment the vertical support member is of a telescoping construction, any other means of making the height adjustable may also be employed.

An elongated elastomeric tread supporting member 13,13' is attached by means for attachment to an upper surface of each end portion 17,17' of the base member. Each tread support member has a longitudinal axis that is parallel to the parallel edge 15,15' of the base member that is included in the end portion of the base member to which the elastomeric tread supporting member is attached. The tread supporting member may comprise natural or synthethic rubber, or any other elastomeric material that will have a high coefficient of friction with the tread of a tire that is placed on the display stand. Preferably a tread supporting member is attached to the upper surface of an end section of the base member with an adhesive, but other means for attachment such as suitable threaded fasteners may be employed for this purpose. Each tread supporting member presents an arcuate surface 21,21' having an axis that is parallel to the longitudinal axis of the tread supporting member. The arcuate surface of each tread supporting member may have a series of parallel grooves 22 therein, with the parallel grooves being parallel to the longitudinal axis of the tread supporting member.

It is clear that the base member having the tread supporting members attached thereto can support tires having a variety of outside diameters, within a given limited range of course. A further advantage is the gripping action of the elastomeric tread supporting members upon the elastomeric tread portion of a tire displayed on the display stand. It is believed that grooves in the arcuate surface of a tread supporting member will enhance this gripping action to restrain a tire from rolling off of the display stand.

An elastomeric bead supporting member 14 is attached by means for attachment, such as an adhesive, to a top surface of the platform 19 located at the upper end of the adjustable height vertical support member. An upper surface of the bead supporting member has a groove 23 therein. The groove extends generally horizontally and is oriented perpendicular to vertical planes containing the longitudinal axes of the tread supporting members 13. "Generally horizontally" is understood to mean a direction that is either linear in a horizontal plane or slightly arcuate to be complementary to a bead portion of a tire while being more horizontally oriented than vertically oriented. The bead portion of a tire may be received in the groove 23 in the elastomeric bead supporting member. The height of the bead supporting member being adjustable via the adjustable height vertical support member so that tires with bead diameters of various sizes can be accommodated by the display stand. The bead portion of a tire normally have elastomeric material on their outer surfaces, so that the relatively high coefficient of friction between the tire's bead portion and the bead supporting member helps to maintain the tire in position on the display stand.

While the preferred embodiments of the invention have been illustrated and described, it will be understood that changes in construction may be made within the scope of the appended claims without departing from the spirit of the invention.

What is claimed is:

1. A tire display stand comprising:

(a) a base member comprising a single sheet of material having a pair of parallel edges, said single sheet being formed to define a flat horizontal central portion and a pair of end portions which each include one of said parallel edges, said end portions being inclined upwardly at acute angles in the range of 35° to 45° from a horizontal plane, a hook shaped projection extending along one edge of the base member substantially perpendicular to said parallel edges;

(b) an adjustable height vertical support member having a lower end that is attached by means for attachment to the central portion of said base member equidistant from said end portions, an upper end of said vertical support member having a generally horizontally extending platform attached thereto first means for attachment;

(c) an elongated elastomeric tread supporting member attached by second means for attachment to an upper surface of each end portion of the base member, each said tread supporting member having a longitudinal axis that is parallel to the parallel edge of said base member that is included in the end portion of the base member to which the tread supporting member is attached, each treat supporting member presenting an arcuate surface having an axis that is parallel to the longitudinal axis of the tread supporting member, said arcuate surfaces having a series of parallel grooves therein, said parallel grooves being oriented parallel to the longitudinal axis of the tread supporting member; and (d) an elastomeric bead supporting member attached by third means for attachment to a top surface of said platform, said bead supporting member having an upper surface with a goove therein, said groove extending generally horizontally and being oriented perpendicular to vertical planes containing the longitudinal axes of said tread supporting members.

* * * * *

UNITED STATES PATENT AND TRADEMARK OFFICE

CERTIFICATE OF CORRECTION

PATENT NO. : 4,573,587

DATED : March 4, 1986

INVENTOR(S) : John S. Matthews, Jr.

It is certified that error appears in the above-identified patent and that said Letters Patent is hereby corrected as shown below:

Column 4, line 33, after "thereto" insert the word --by--.

Column 4, line 42, delete "treat" and replace therewith --tread--.

Signed and Sealed this

Eleventh Day of November, 1986

*Attest:*

DONALD J. QUIGG

*Attesting Officer*

*Commissioner of Patents and Trademarks*